US008639152B2

(12) United States Patent
Yamaura

(10) Patent No.: US 8,639,152 B2
(45) Date of Patent: Jan. 28, 2014

(54) CLEANING MEMBER FOR IMAGE FORMING DEVICE, CHARGING DEVICE, PROCESS CARTRIDGE, AND IMAGE FORMING DEVICE

(75) Inventor: Masaaki Yamaura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 444 days.

(21) Appl. No.: 12/877,396

(22) Filed: Sep. 8, 2010

(65) Prior Publication Data

US 2011/0170898 A1 Jul. 14, 2011

(30) Foreign Application Priority Data

Jan. 13, 2010 (JP) ..... 2010-005277

(51) Int. Cl.
*G03G 21/00* (2006.01)
*G03G 15/02* (2006.01)
*G03G 15/16* (2006.01)

(52) U.S. Cl.
USPC ..... 399/99; 399/100; 399/101; 399/357

(58) Field of Classification Search
USPC ..... 399/111, 115, 99–101, 123, 357
See application file for complete search history.

(56) References Cited

U.S. PATENT DOCUMENTS 7,463,845 B2 * 12/2008 Suda et al. ..... 399/115
2008/0025753 A1 * 1/2008 Yamamoto et al. ..... 399/100

FOREIGN PATENT DOCUMENTS

JP A-2007-199414 8/2007
JP A-2008-033170 2/2008
JP A-2008-070532 3/2008
JP A-2008-304729 12/2008

OTHER PUBLICATIONS

Oct. 1, 2013 Office Action issued in Japanese Patent Application No. 2010-005277 (with partial translation).

* cited by examiner

*Primary Examiner* — David Gray
*Assistant Examiner* — Andrew Do
(74) *Attorney, Agent, or Firm* — Oliff & Berridge, PLC

(57) ABSTRACT

A cleaning member 100 is constituted, for example, by a roll-shaped member having a shaft 100A and an elastic layer 100B. The elastic layer 100B is spirally disposed on the surface of the shaft 100A. A space 100C enclosed by the spirally disposed elastic layer 100B (side surface thereof) and the shaft 100A (outer circumferential surface thereof) is provided and a filling member 100D for filling the space 100C is disposed in a portion of the space 100C.

11 Claims, 12 Drawing Sheets

CLEANING MEMBER FOR IMAGE FORMING DEVICE, CHARGING DEVICE, PROCESS CARTRIDGE, AND IMAGE FORMING DEVICE

CROSS-REFERENCE TO RELATED APPLICATIONS

This application is based on and claims priority under 35 USC 119 from Japanese Patent Application No. 2010-005277 filed on Jan. 13, 2010.

BACKGROUND

1. Technical Field

The present invention relates to a cleaning member for an image forming device, a charging device, a process cartridge, and an image forming device.

2. Related Art

Cleaning members for an image forming device are known in publications.

SUMMARY

According to an aspect of the invention, there is provided a cleaning member for an image forming device, including: a spindle; a belt-like elastic body spirally wound around an outer circumferential surface of the spindle; and a filling member for filling one portion of a space enclosed by the spindle and the spirally wound belt-like elastic body.

BRIEF DESCRIPTION OF THE DRAWINGS

Exemplary embodiments of the present invention will be described in detail based on the following figures, wherein.

DETAILED DESCRIPTION

Figure 1:
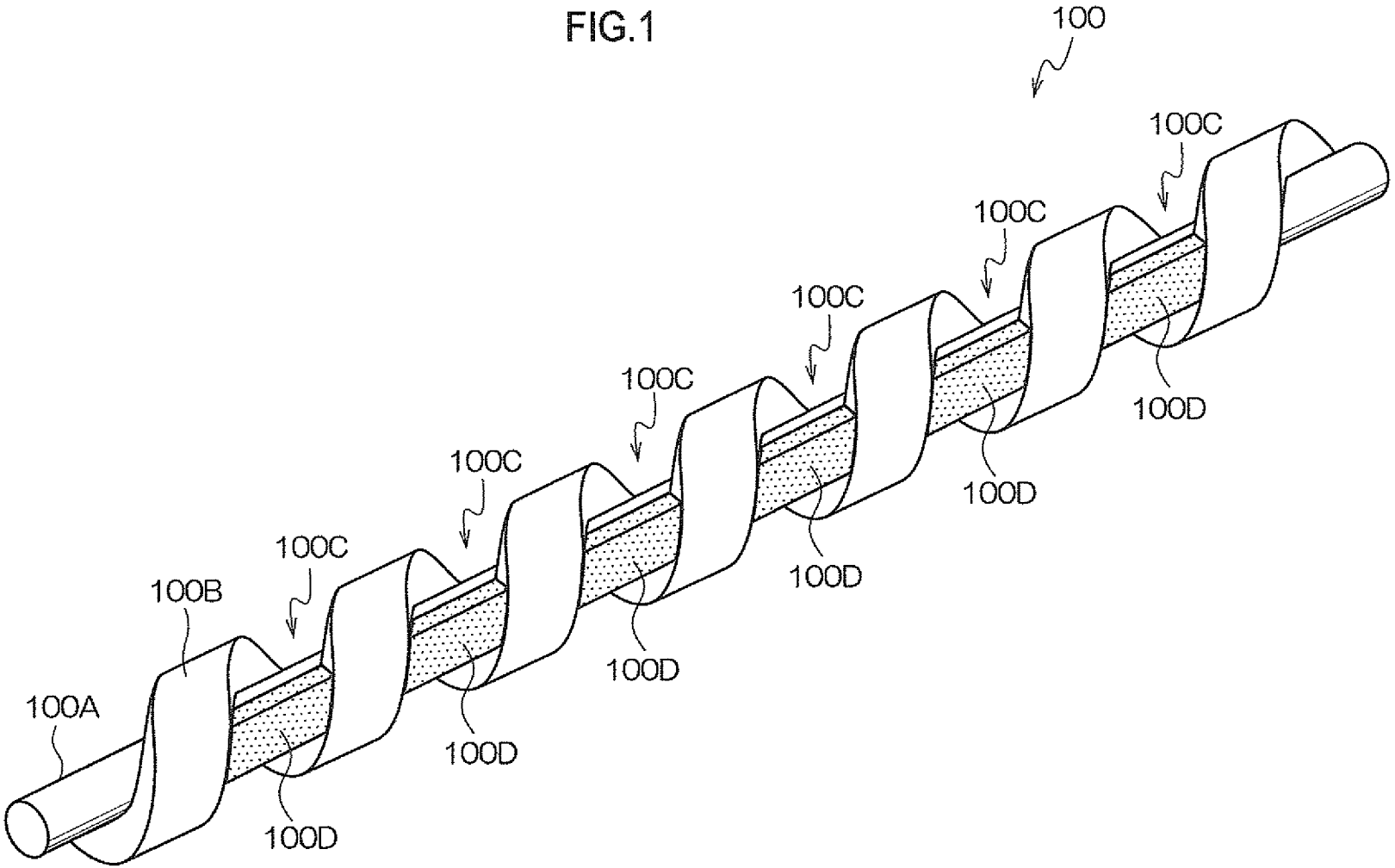
FIG. 1 is a perspective view schematically showing a cleaning member for an image forming device according to the exemplary embodiment.

Hereinafter, an exemplary embodiment which is an example of the present invention will be described. Members having the same function and the same action are designated by the same reference numerals through the drawings and the description of the members is sometimes omitted.

Cleaning Member

Figure 2:
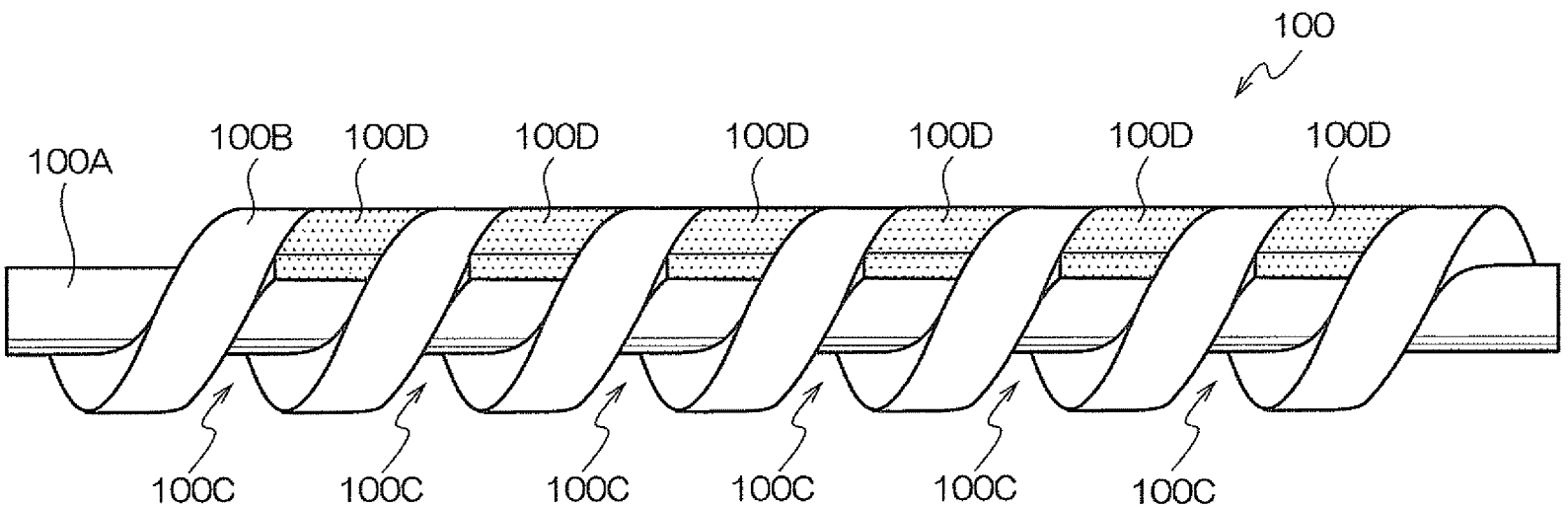
FIG. 2 is a plan view schematically showing the cleaning member for an image forming device according to the exemplary embodiment.

FIG. 1 is a perspective view schematically showing a cleaning member for an image forming device according to the exemplary embodiment. FIG. 2 is a plan view schematically showing the cleaning member for an image forming device according to the exemplary embodiment.

A cleaning member 100 for an image forming device according to the exemplary embodiment (hereinafter simply referred to as a cleaning member) is a roll-shaped member having a shaft 100A as a spindle and an elastic layer 100B as a belt-like elastic body as shown in FIGS. 1 and 2. The elastic layer 100B is disposed while being spirally wound around a surface of the shaft 100A. Specifically, for example, the elastic layer 100B is disposed while being spirally wound with an interval around the axis of the shaft 100A as a screw axis from one end to the other end of the shaft 100A.

The cleaning member 100 according to this exemplary embodiment has spaces 100C each enclosed by the spirally disposed elastic layer 100B (side surface thereof) and the shaft 100A (outer circumferential surface thereof). The spaces 100C are also spirally disposed with an interval around the axis of the shaft 100A as a screw axis.

Then, filling members 100D for filling the spaces 1000 are placed in a portion of each of the spaces 100C. More specifically, the filling members 100D are provided in a portion of a target space 100C so as to be embedded while being adhered to the side surface of the elastic layer 100B and the outer circumferential surface of the shaft 100A (as required, adhered through an adhesive layer).

Hereinafter, each member will be described in detail.

First, the shaft will be described.

Examples of materials for use in the shaft 100A include metals (e.g., free cutting steel or stainless steel) or resin (e.g., polyacetal resin (POM)). The materials and surface treatment methods are preferably selected as required.

In particular, in a case in which the shaft 100A is composed of metals, a plating treatment is preferably performed. In a case in which the shaft 100A is composed of materials having no conductivity, such as, resin, the shaft 100A may be subjected to a general treatment, such as a plating treatment, in order to impart conductivity to the shaft. Alternatively the shaft 100A may be used as it is.

Next, the elastic layer will be described.

The elastic layer 100B is spirally disposed and specifically, the helix angle θ is preferably from 10° to 65° or about 10° to about 65°, and the spiral width R1 is preferably from 3 mm to 25 mm or about 3 mm to about 25 mm, for example. The spiral pitch R2 is preferably from 3 mm to 40 mm or about 3 mm to about 40 mm, for example.

Figure 3:
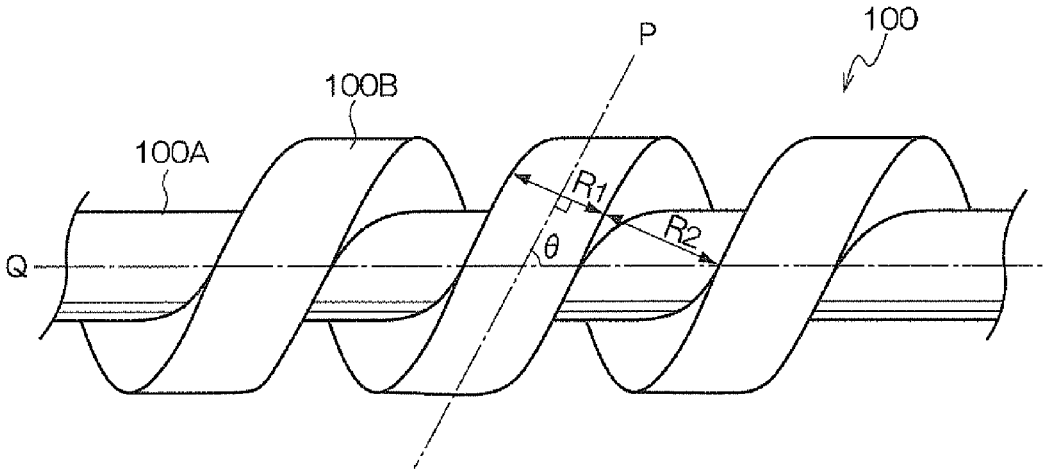
FIG. 3 is an enlarged sectional view showing an elastic layer in the cleaning member for an image forming device according to the exemplary embodiment.

Here, as shown in FIG. 3, the helix angle θ refers to an angle (acute angle) formed by intersection of the longitudinal direction P of the elastic layer 100B (spiral direction) and the axial direction Q of the cleaning member (shaft axial direction).

The spiral width R1 refers to a length along a direction orthogonal to the longitudinal direction P (spiral direction) of the elastic layer 100B.

The spiral pitch R2 refers to a length between the adjacent elastic layers 100B along the direction orthogonal to the longitudinal direction P (spiral direction) of the elastic layer 100B.

The elastic layer 100B refers to a layer containing materials that recover the original shape even when the materials are deformed by the application of external force of 100 Pa.

Examples of the materials of the elastic layer 100B include foaming resin, such as polyurethane, polyethylene, polyamide, or polypropylene and rubber materials, such as silicone rubber, fluoropolymer rubber, urethane rubber, ethylene-propylene-diene terpolymer rubber (EPDM), acrylonitrile-butadiene copolymer rubber (NBR), chloroprene rubber (CR), chlorinated polyisoprene rubber, isoprene rubber, styrene-butadiene rubber, hydrogenated polybutadiene rubber, or butyl rubber. These materials may be used solely or as a blend of two or more kinds thereof. To the material, auxiliary agents, such as foaming auxiliary agents, foam stabilizers, catalysts, hardening agents, plasticizers, or vulcanization accelerators, may be added, as required.

Among these, materials having foams (a so-called foamed material) are preferable. From the viewpoint that the surface of a member to be cleaned is not scratched due to rubbing and breakage or damage is not caused over a long period of time, foamed polyurethane having resistance against tension is preferable.

Examples of the polyurethane include reaction products of polyol (e.g., polyesterpolyol, polyetherpolyol, or acrylic polyol) and isocyanate (e.g., 2,4-tolylenediisocyanate, 2,6-tolylenediisocyanate, 4,4-diphenylmethanediisocyanate, tolidinediisocyanate, and 1,6-hexamethylene diisocyanate), and a chain extender (1,4-butanediol and trimethylolpropane) may be contained in the reaction product. The foaming of polyurethane is generally performed using, for example, water or foaming agents, such as azo compounds (e.g., azodicarbonamide and azobisisobutyronitrile). To the foamed polyurethane, auxiliary agents, such as foaming auxiliary agents, foam stabilizers, or catalysts, may be added, as required.

The structure of the elastic layer 100B may be a single layer structure or a multilayer structure. Specifically, the structure of the elastic layer 100B may be, for example, a single layer containing foam, or a two-layer structure of a solid layer and a foamed layer.

Next, the filling member will be described.

The filling members 100D are disposed, for example, in a straight line in such a manner as to fill the spaces 100C along an axial direction of the shaft 100A. More specifically, for example, the filling members 100D are disposed so as to fill a portion of the spirally disposed spaces 100C so that the elastic layer 100B and the filling members 100D are alternately arranged along the axial direction of the shaft 100A.

As a result, the cleaning member 100 has a region contacting a member to be cleaned throughout the axial direction of the shaft 100A due to both the elastic layer 100B and the filling members 100D at a portion of a circumferential direction of the shaft 100A. In contrast, where the filling members 100D are not disposed, a non-contact region to the member to be cleaned is always present.

When two or more of the filling members 100D provided in a straight line in such a manner as to fill the spaces 100C along the axial direction of the shaft 100A are made as one set, an aspect in which the set is singly provided may be acceptable or an aspect in which two or more of the sets are provided with an interval in the circumferential direction of the shaft 100A may be acceptable (This exemplary embodiment describes an aspect in which the set is singly provided).

However, in this case, for example, the length along the circumferential direction of the shaft 100A in the filling members 100D (total length when two or more of the sets are provided: hereinafter sometimes referred to as a length in the circumferential direction) is preferably ½ or less or about ½ or less of a length of the cleaning member 100 along the circumferential direction of the shaft 100A (hereinafter sometimes referred to as a length in the circumferential direction).

This is because when the length along the circumferential direction of the shaft 100A in the filling members 100D is excessively long, the shape of the cleaning member 100 is close to a cylindrical shape, and thus cleanability derived from the spiral elastic layer 100B tends to decrease.

The lower limit of the length of circumferential direction is preferably 3 mm from the viewpoint of suppressing the separation of the filling members 100D.

Figure 4:
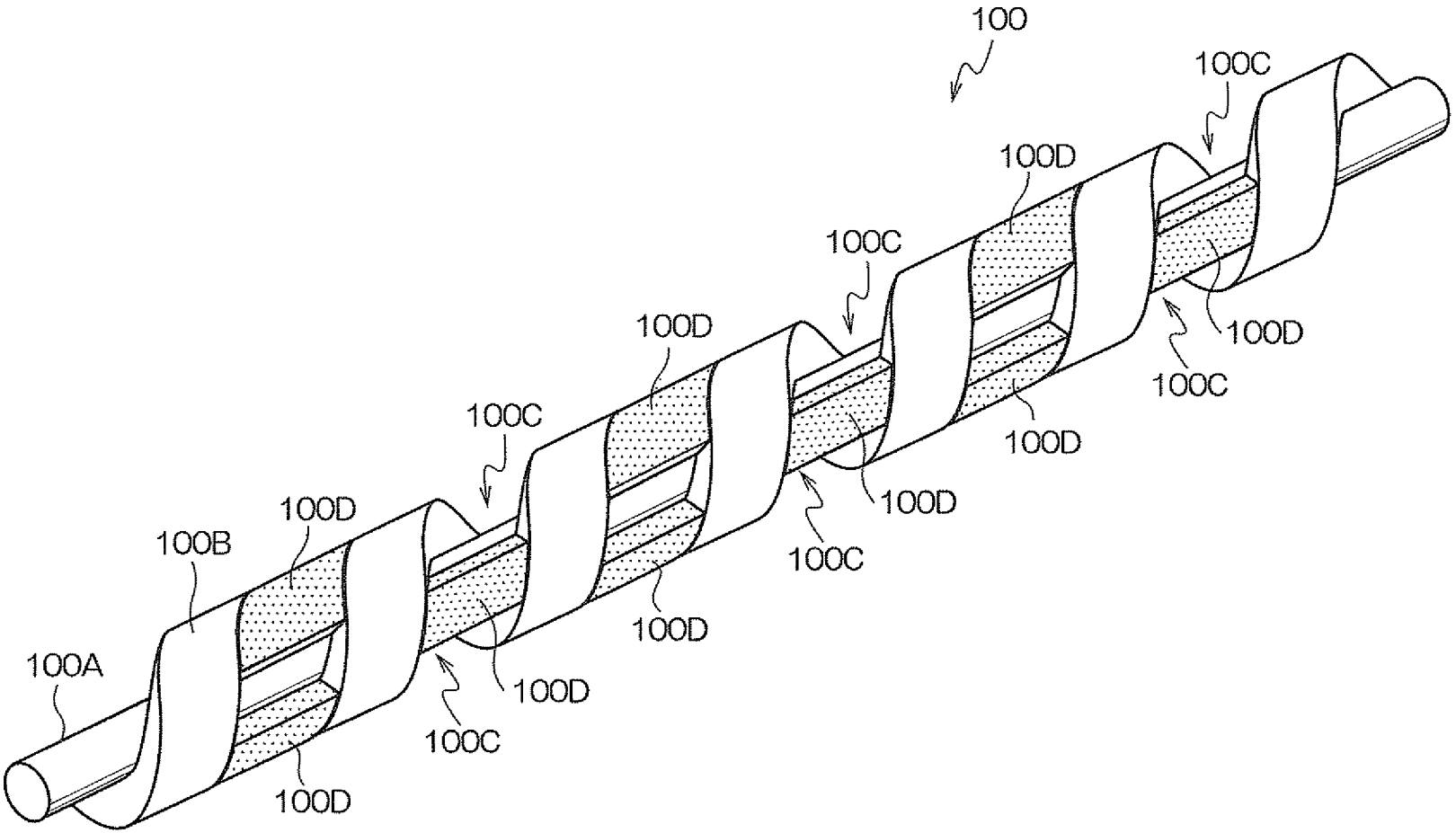
FIG. 4 is a perspective view schematically showing another example of the cleaning member for an image forming device according to the exemplary embodiment.

Here, the filling members 100D may be provided so as to fill a portion of the spiral spaces 100C without being limited to an aspect in which the filling members 100D are provided in a straight line so as to fill the spaces 100C along an axial direction of the shaft 100A. For example, as shown in FIG. 4, an aspect in which two or more of the filling members 100D may be disposed in a lattice configuration or the like so as to fill the spiral spaces 100C at an interval in the spiral direction.

The region filled with the filling member 100D is preferably ½ or less or about ½ or less with respect to an area of the outer circumferential surface (a total surface area of the elastic layer 100B and the filling member 100D) of the cleaning member 100, assuming that the spiral space 100C is fully embedded with the filling member 100D.

This is because when the region filled with the filling member 100D is excessively large, the shape of the cleaning member 100 is close to a cylindrical shape, and thus cleanability derived from the spiral elastic layer 100B tends to decreases.

Considering the fact that the filling members 100D are provided so as to fill a portion of the spiral spaces 100C, i.e., the filling members 100D are embedded in a portion of the spaces 100C, the thickness thereof is preferably the same as that of the elastic layer 100B (±0.5 mm).

Examples of materials of the filling members 100D include the same materials as those of the elastic layer 100B. The filling members 100D may contain the same materials as those of the elastic layer 100B or may contain different materials. However, from the viewpoint of suppressing the initial charge unevenness to a member to be cleaned under a low temperature and low humidity environment, the filling members 100D preferably contain the same materials as those of the elastic layer 100B.

Next, a method for producing the cleaning member 100 according to this exemplary embodiment will be described.

Examples of the method for producing the cleaning member 100 according to this exemplary embodiment include the following methods:

1) A method includes preparing a member for an elastic layer (foamed polyurethane or the like) molded into the shape of a rectangular column, forming a hole into which the shaft 100A is inserted in the member for an elastic layer with a drill or the like, inserting the shaft 100A having an adhesive-applied outer circumferential surface into the hole of the member for an elastic layer, cutting the member for an elastic layer to form the elastic layer 100B, and then embedding a component functioning as the filling members 100D in a portion of the spiral spaces 100C, thereby obtaining the cleaning member 100;

2) A method includes preparing a member for an elastic layer (foamed polyurethane or the like) having a columnar shape molded by a die, forming a hole into which the shaft 100A is inserted in the member for an elastic layer with a drill or the like, inserting the shaft 100A having an adhesive-applied outer circumferential surface into the hole of the member for an elastic layer, and then embedding a component functioning as the filling members 100D in a portion of the spiral spaces 100C, thereby obtaining the cleaning member 100; and 3) A method includes preparing a sheet-like member for an elastic layer (foamed polyurethane sheet or the like), adhering a pressure-sensitive adhesive double-coated tape thereto, punching the same to obtain a strip, winding the strip around the shaft 100A to form the elastic layer 100B, and embedding a component functioning as the filling member 100D in a portion of the spiral spaces 100C, thereby obtaining the cleaning member 100.

Among the above, the method including winding a strip around the shaft to form the elastic layer 100B, thereby obtaining a cleaning member is simple, and thus is preferable.

An aspect in which the filling member 100D are separately provided from the elastic layer 100B is described in the above description. However, the aspect is not limited thereto, and the filling member 100D may be a member integrated with the elastic layer 100B obtained by cutting the elastic layer 100B while remaining regions corresponding to the filling members 100D when forming the elastic layer 100B into a spiral shape by the cutting processing or by molding regions corresponding to the filling members 100D by a die at the same time when the elastic layer 100B is molded by a die.

In the cleaning member 100 according to this exemplary embodiment described above, the spirally disposed elastic layer 100B cleans a surface (surface to be cleaned) of a member to be cleaned in such a manner as to repeat contact/non-contact with the surface while rotating. When viewed from the surface (surface to be cleaned) of the member to be cleaned, a corner (edge) of both ends in the spiral width direction of the elastic layer 100B performs cleaning by force applied in the axial direction of the shaft 100A (spiral axis direction).

Figure 5A:
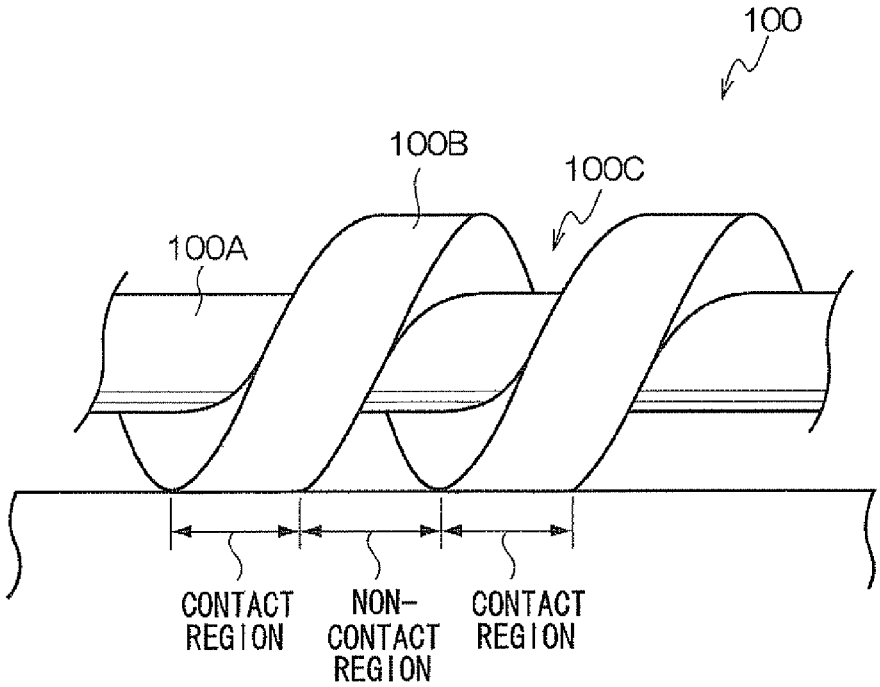
FIG. 5A and FIG. 5B are schematic views for describing the action of the cleaning member for an image forming device according to the exemplary embodiment.

Here, in the cleaning member 100, since the elastic layer 100B is spirally disposed, a region (contact region) contacting the surface (surface to be cleaned) of the member to be cleaned and a region (non-contact region) not contacting the surface are present (FIG. 5A). On the surface (surface to be cleaned) of the member to be cleaned, friction charge arises in the contact region with the elastic layer 100B, but friction charge does not arise in the non-contact region with the elastic layer 100B. Then, in the early stage of cleaning, the surface (surface to be cleaned) of the member to be cleaned has a region where there is a potential difference over the axial direction of the cleaning member 100. More specifically, by the time when the elastic layer 100B contacts the surface (surface to be cleaned) of the member to be cleaned over the axial direction of the cleaning member 100 by the rotation of the cleaning member 100, so that the potential of the surface to be cleaned becomes uniform, a region having a potential difference is present on the surface (surface to be cleaned) of the member to be cleaned, i.e., charge unevenness occurs. In particular, the charge unevenness markedly arises under low temperature and low humidity environment.

Figure 5B:
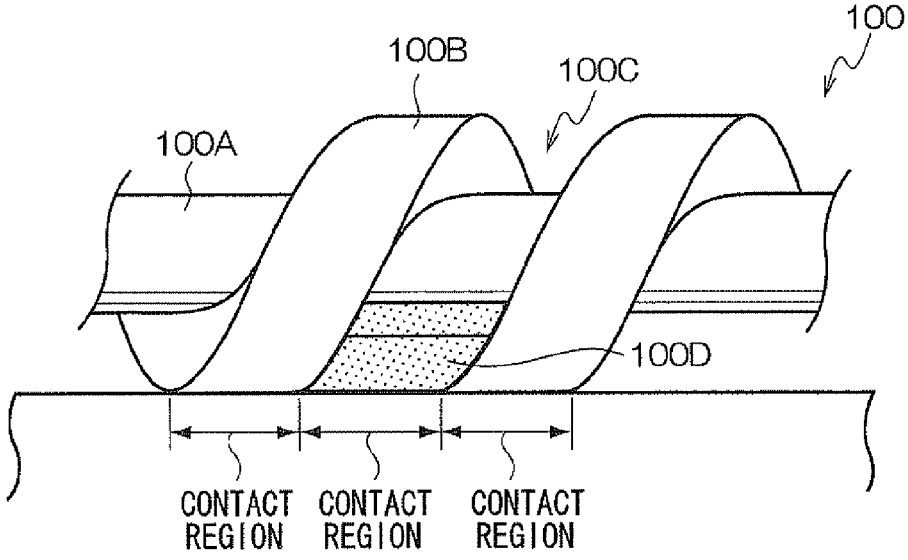

Then, in the cleaning member 100 according to this exemplary embodiment, the spaces 100C surrounded by the shaft 100A and the spirally disposed elastic layer 100B are partially filled with the filling members 100D. More specifically, also in the spiral spaces 100C not contacting the surface (surface to be cleaned) of the member to be cleaned (see FIG. 5(A)), the opportunity of contacting the surface (surface to be cleaned) of the member to be cleaned is given by the filling members 100D (see FIG. 5B). Therefore, by rotation of the cleaning member 100, a time for contacting the surface (surface to be cleaned) of the member to be cleaned over the axial direction of the cleaning member 100 is reduced, i.e., a potential of the surface to be cleaned becomes uniform whereby the region having a potential difference disappears.

In particular, in the cleaning member 100 according to this exemplary embodiment, since the filling members 100D are provided in the shape of a straight line in such a manner as to fill the spaces 100C along the axial direction of the shaft 100A, a region where the elastic layer 100B and the filling members 100D contact the member to be cleaned over the axial direction of the shaft 100A is present in a portion in the circumferential direction of the shaft 100A. More specifically, during a 360-degree roll of the cleaning member 100, at least an opportunity that makes the elastic layer 100B and the filling member 100D simultaneously contact the member to be cleaned over the axial direction of the shaft 100A is given, i.e., an opportunity that makes the cleaning member 100 completely contact the member to be cleaned without non-contacting portions over the axial direction of the shaft 100A is given.

Image Forming Device and the Like

Hereinafter, an image forming device according to this exemplary embodiment will be described with reference to the drawings.

Figure 6:
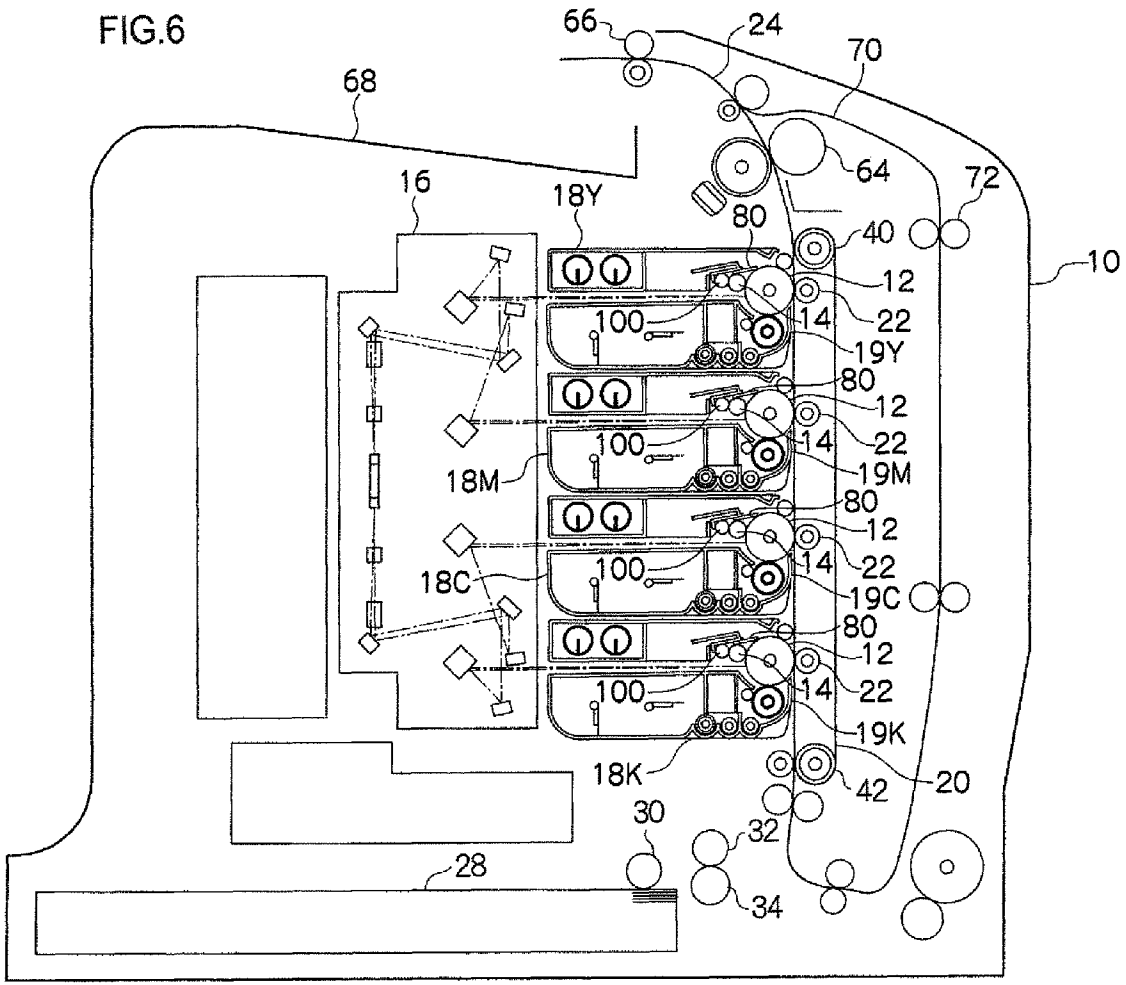
FIG. 6 is a schematic configuration diagram showing an electrophotographic image forming device according to the exemplary embodiment.

FIG. 6 is a schematic configuration diagram showing an image forming device according to this exemplary embodiment.

Figure 7:
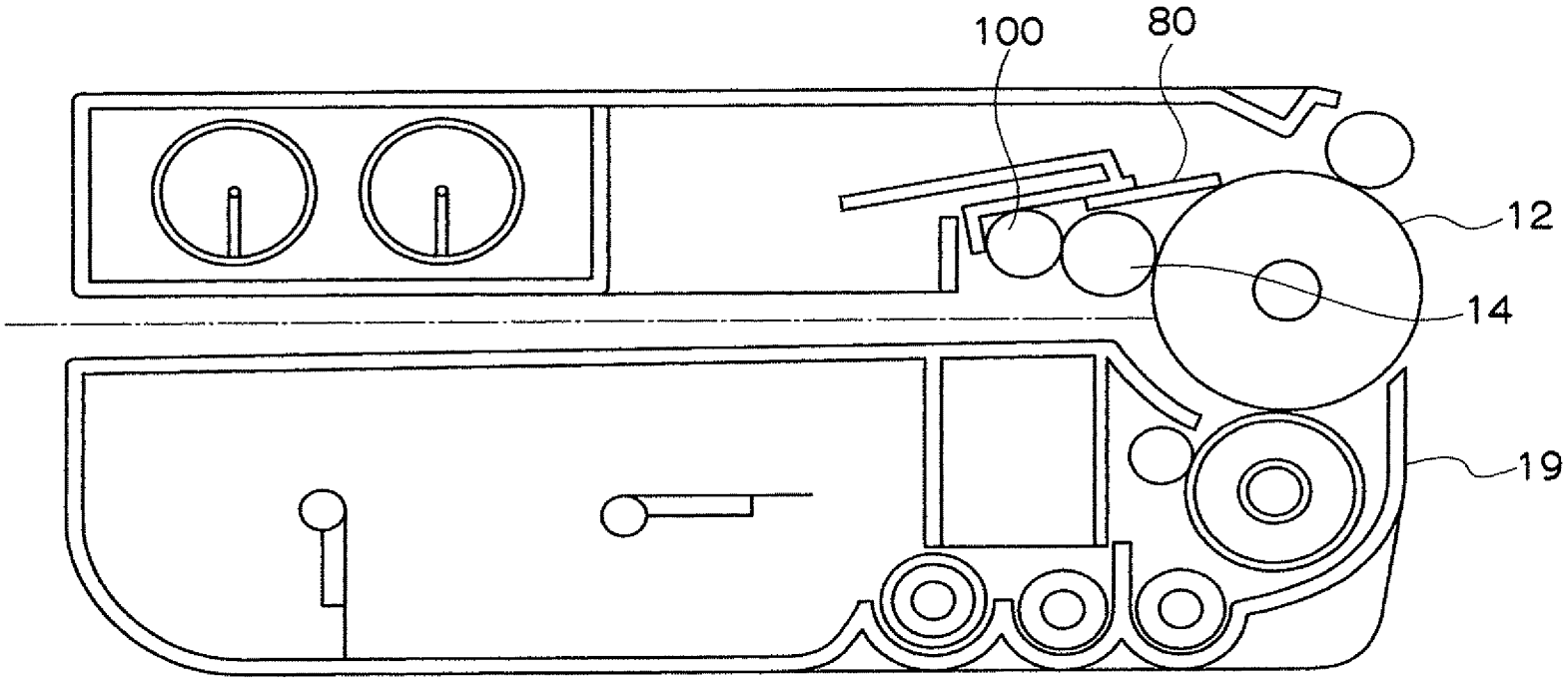
FIG. 7 is a schematic configuration diagram showing a process cartridge according to the exemplary embodiment.

An image forming device 10 according to this exemplary embodiment is a tandem-system color image forming device, for example, as shown in FIG. 6. The image forming device 10 according to this exemplary embodiment incorporates, for example, a photoreceptor (image holder) 12, a charging member 14, development devices in which process cartridges (FIG. 7) for colors of yellow (18Y), magenta (18M), cyan (18C), and black (18K) are installed respectively. The process cartridge is detachably incorporated in the image forming device 10.

As the photoreceptor 12, for example, a conductive cylindrical material having a diameter of 25 mm whose surface is covered with a photoreceptor layer containing an organic sensitive material is used, and is driven by rotation at a process speed of 150 mm/sec by a motor not shown.

The surface of the photoreceptor 12 is charged by the charging member 14 disposed above the surface of the photoreceptor 12. Then, an image is exposed by a laser beam LB emitted from an exposure device 16 at the down-stream side of the rotation direction of the photoreceptor 12 relative to the charging member 14 to form an electrostatic latent image according to image information.

The electrostatic latent image formed on the photoreceptor 12 is developed by development devices 19Y, 19M, 19C, and 19K for colors of yellow (Y), magenta (M), cyan (C), and black (K), to obtain a toner image corresponding to each of the above colors.

For example, when a color image is formed, each process of charging, exposure, and development is performed corresponding to each color of yellow (Y), magenta (M), cyan (C), and black (K) on the surface of the photoreceptor 12 for each color, so that a toner image corresponding to each color of yellow (Y), magenta (M), cyan (C), and black (k) is formed on the surface of the photoreceptor 12 for each color.

The toner image of each color of yellow (Y), magenta (M), cyan (C), and black (K) successively formed on the photoreceptor 12 is transferred to a recording paper 24 that is conveyed to the outer circumference of the photoreceptor 12 on a sheet conveying belt 20 at a portion where the photoreceptor 12 contacts a transfer device 22 through the sheet conveying belt 20. The recording paper 24 to which the toner image has been transferred from the photoreceptor 12 is conveyed to a fixing device 64, and is heated and pressed by the fixing device 64, whereby the toner image is fixed onto the recording paper 24. Thereafter, in the case of one-side printing, the recording paper 24 to which the toner image is fixed is discharged as it is by a discharge roll 66 onto a discharge portion 68 provided in the upper portion of the image forming device 10.

In contrast, in the case of double-side printing, the recording paper 24 having a first surface (front surface) to which the toner image is fixed by the fixing device 64 is not discharged as it is onto the discharge portion 68 by the discharge roll 66. Then, in a state where the back end portion of the recording paper 24 is held by the discharge roll 66, the discharge roll 66 is reversed and simultaneously therewith the conveying path of the recording paper 24 is switched to a paper conveying path for double-side printing 70. Then, in the state where the back and front surfaces of the recording paper 24 are reversed, the recording paper 24 is conveyed again to the sheet conveying belt 20 by a conveying roll 72 disposed on the paper conveying path for double-side printing 70, thereby transferring a toner image to a second surface (back surface) of the recording paper 24 from the photoreceptor 12. Then, the toner image on the second surface (back surface) of the recording paper 24 is fixed by the fixing device 64, and the recording medium 24 (a transfer medium) is discharged onto the discharge portion 68.

The surface of the photoreceptor 12 after the transfer process of the toner image is completed is ready for the following image formation process by removing residual toner, paper powder, and the like by a cleaning blade 80 disposed on the surface of the photoreceptor 12 and at the down-stream side of the rotating direction of the photoreceptor 12 relative to the portion contacting the transfer device 22 with respect to each 360-degree rotation of the photoreceptor 12.

Figure 8:
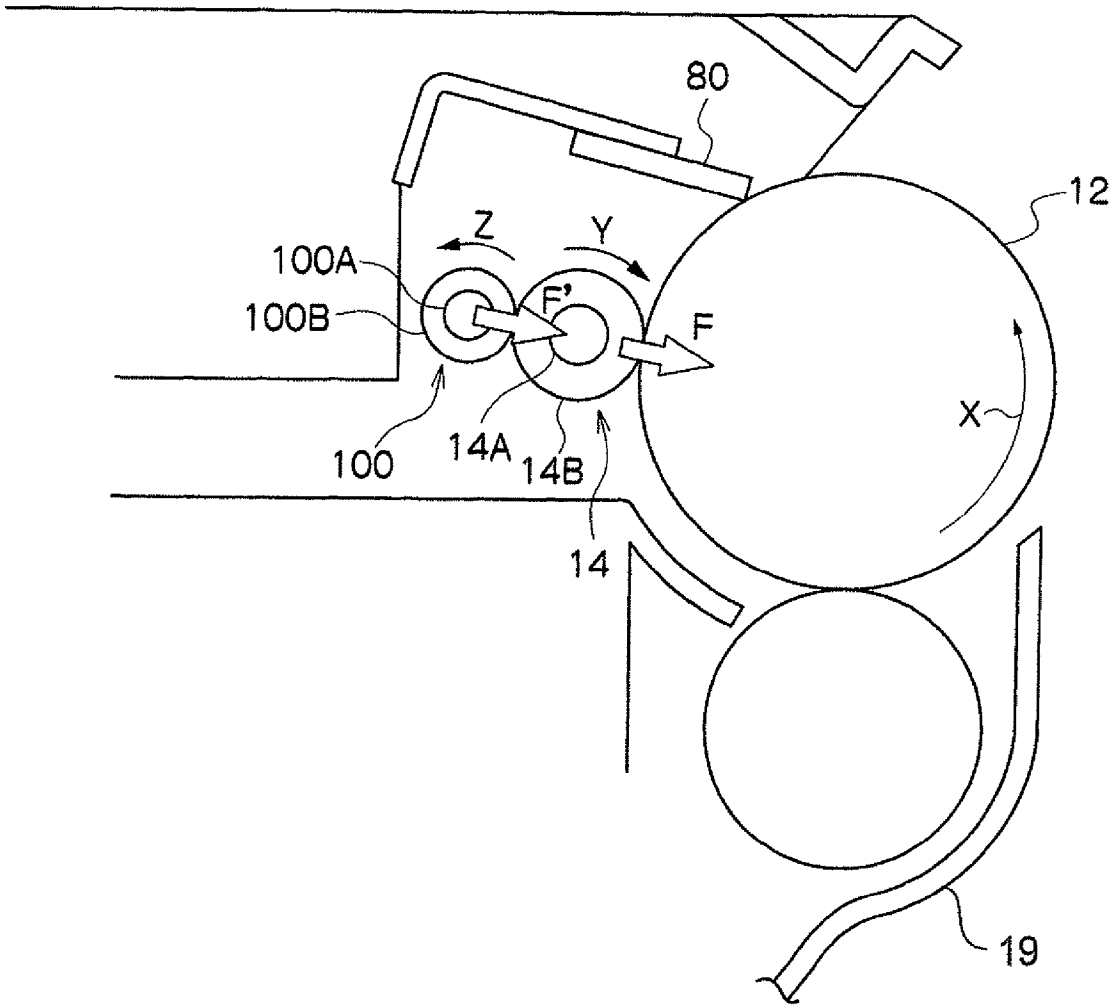
FIG. 8 is a schematic configuration diagram showing an enlarged peripheral portion of a charging member (charging device) in FIGS. 6 and 7.
Figure 9:
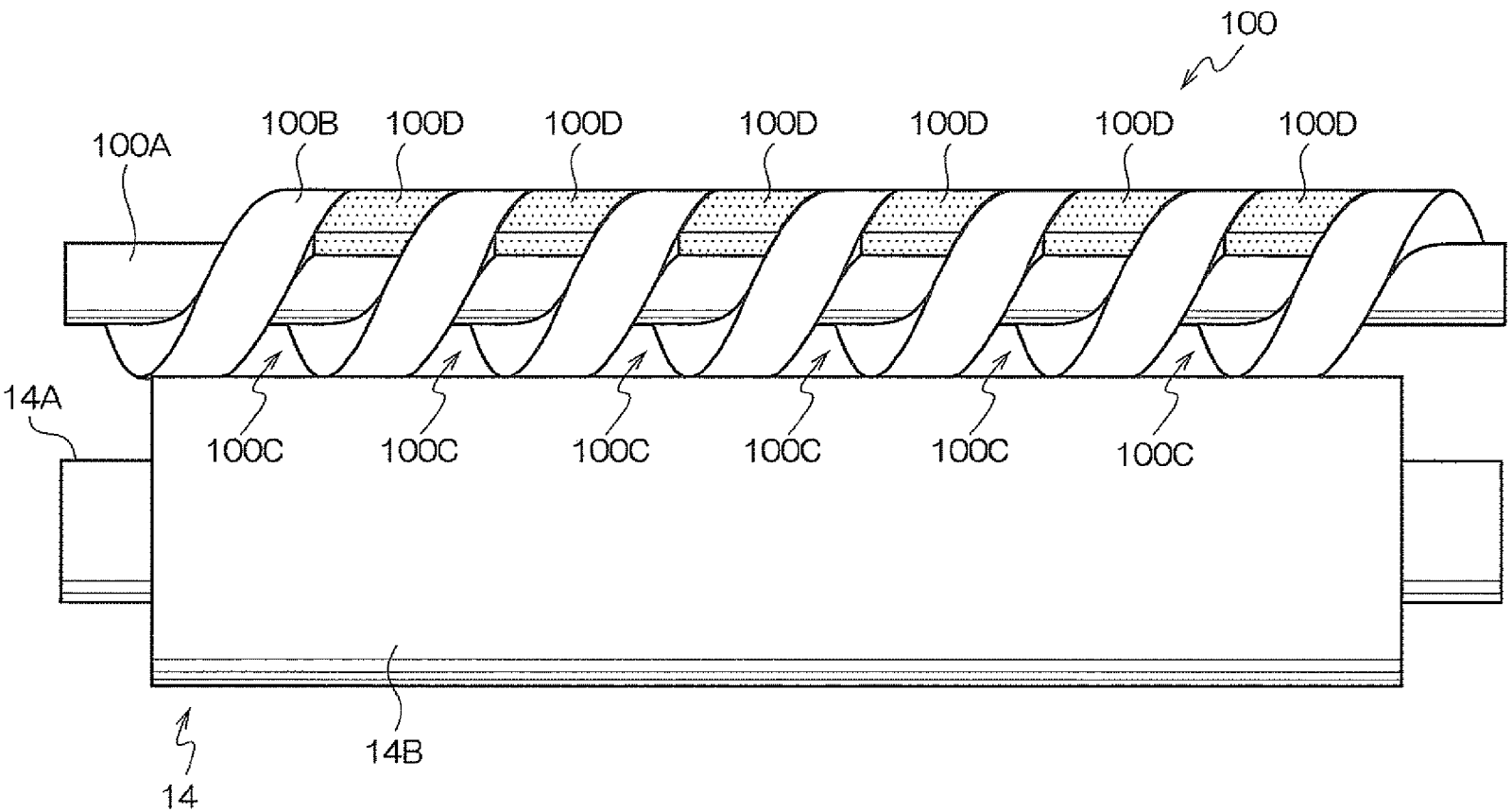
FIG. 9 is a schematic configuration diagram showing the charging device according to the exemplary embodiment.

Here, as shown in FIGS. 8 and 9, the charging member 14 is, for example, a roll in which the elastic layer 14B is formed on the circumference of the conductive shaft 14A and the shaft 14A is rotatably supported. The cleaning member 100 for the charging member 14 contacts the charging member 14 at the side where the charging member 14 does not contact the photoreceptor 12 to constitute a charging device (unit). As the cleaning member 100, the cleaning member 100 according to this exemplary embodiment is used.

The charging member 14 is pressed against the photoreceptor 12 by applying a load F to both ends of the shaft 14A so as to be elastically deformed along the circumferential surface of the elastic layer 14B, thereby forming a nip portion. Furthermore, the cleaning member 100 is pressed against the charging member 14 by applying a load F' to both ends of the shaft 100A, so that the elastic layer 100B is elastically deformed along the circumferential surface of the charging member 14 to form a nip portion, thereby suppressing bending of the charging member 14 to form a nip portion in the axial direction of the charging member 14 and the photoreceptor 12.

The photoreceptor 12 is driven by rotation in the direction of the arrow X by a motor not shown, and the charging member 14 is driven and rotated in the direction of the arrow Y by the rotation of the photoreceptor 12. The cleaning member 100 is driven and rotated in the direction of the arrow Z by the rotation of the charging member 14.

Structure of Charging Member

Hereinafter, the charging member will be described but, in this exemplary embodiment, the structure thereof is not limited to the following structure. The description is given while omitting the reference numerals.

The structure of the charging member is not limited, and examples include a structure having a shaft and an elastic layer or a resin layer in place of the elastic layer. The elastic layer may have a single layer structure or a multilayer structure containing plural different layers having various functions. Furthermore, the elastic layer may be surface treated.

It is preferable to use free cutting steel, stainless steel, or the like as the material of the shaft and to select proper materials and surface treatment methods as appropriate according to purposes such as slidability. A plating treatment is preferably performed. In a case in which materials have no conductivity, the materials may be subjected to a conductive treatment by general treatment, such as plating treatment. Alternatively, the materials may be used as they are.

The elastic layer is a conductive elastic layer, and to the conductive elastic layer, it is possible to add materials that can be generally added to a rubber, such as elastic materials such as a rubber having elasticity; conductive materials such as carbon black or an ion-conductive material that adjusts the resistance of the conductive elastic layer; and, as required, softeners, plasticizers, hardening agents, vulcanizing agents, vulcanizing accelerator, anti-aging agents, or fillers such as silica or calcium carbonate. The elastic layer is formed by covering the circumferential surface of a conductive shaft with a mixture containing materials that are generally added to a rubber. Examples of a conductive agent aiming at the adjustment of the resistance value include an agent in which materials that electrically conduct through at least one of electrons and ions of carbon black or an ion-conductive agent to be blended with a matrix material as a charge carrier are dispersed. The elastic material may be a foamed material.

Elastic materials constituting the conductive elastic layer are formed, for example, by dispersing conductive agents in rubber materials. Preferable examples of the rubber materials include silicone rubber, ethylene propylene rubber, epichlorohydrin-ethylene oxide copolymer rubber, epichlorohydrin-ethylene oxide-allyl glycidyl ether copolymer rubber, acrylonitrile-butadiene copolymer rubber, and a blend rubber thereof. These rubber materials may be a foamed material, or may not be a foamed material.

Examples of the conductive agent include electron-conductive agents or ion-conductive agents. Examples of the electron-conductive agents include a fine powder of, for example, carbon black such as Ketjenblack or acetylene black; pyrolysis carbon, graphite; various conductive metals or alloys such as aluminum, copper, nickel, or stainless steel; various conductive metal oxides such as tin oxide, indium oxide, titanium oxide, tin oxide-antimony oxide solid solution, or tin oxide-indium oxide solid solution; or insulators whose surface has been subjected to conductive treatment. Examples of the ion-conductive agents include perchlorates, chlorates or the like of tetraethylammonium, lauryltrimethylammonium or the like; and perchlorates, chlorates or the like of alkaline metals, or alkaline-earth metals, such as lithium or magnesium.

The conductive agents may be used singly or in combination of two or more thereof. The added amount thereof is not particularly limited. In the case of using the electron-conductive agents, the added amount is preferably in the range of from 1 part by weight to 60 parts by weight relative to 100 parts by weight of a rubber material. In contrast, in the case of using the ion-conductive agents, the added amount is preferably in the range of from 0.1 parts by weight to 5.0 parts by weight relative to 100 parts by weight of a rubber material.

On the surface of the charging member, a surface layer may be formed. As materials of the surface layer, any material, such as resin or rubber, may be used and the materials are not particularly limited. Preferable examples include polyvinylidene fluoride, a tetrafluoroethylene copolymer, polyester, polyimide, and a copolymerized nylon.

The copolymerized nylon contains one or two or more of 610 nylon, 11 nylon, or 12 nylon as a polymerization unit. Examples of other polymerization units contained in the copolymer include 6 nylon and 66 nylon. Here, the proportion of the polymerization unit containing 610 nylon, 11 nylon, or 12 nylon contained in the copolymer is preferably 10% or more in total in terms of weight ratio.

Polymer materials may be used singly or as a mixture of two or more thereof. The number average molecular weight of the polymer materials is in the range of preferably from 1,000 to 100,000 and more preferably from 10,000 to 50,000.

The surface layer may contain a conductive material so as to adjust the resistance value. The conductive material preferably has a particle diameter of 3 μm or lower.

Examples of conductive agents for adjusting a resistance value include agents in which materials that electrically conduct through at least one of electrons or ions of carbon black or conductive metal oxide particles to be blended with a matrix material, or ion-conductive agents as a charge carrier are dispersed.

Specific examples of the carbon black of the conductive agents include "SPECIAL BLACK 350", "SPECIAL BLACK 100", "SPECIAL BLACK 250", "SPECIAL BLACK 5", "SPECIAL BLACK 4", "SPECIAL BLACK 4A", "SPECIAL BLACK 550", "SPECIAL BLACK 6", "COLOR BLACK FW200", "COLOR BLACK FW2", AND "COLOR BLACK FW2V" (all trade names, manufactured by Degussa), and "MONARCH1000", "MONARCH1300", "MONARCH1400" "MOGUL-L", and "REGAL400R" (all trade names, manufactured by Cabot Corp.).

The pH of the carbon black is preferably 4.0 or lower.

The conductive metal oxide particles which are conductive particles for adjusting the resistance value can be any conductive agent containing particles having conductivity, such as tin oxide, antimony-doped tin oxide, zinc oxide, anatase type titanium oxide, and tin oxide indium (ITO). The conductive metal oxide particles are not particularly limited, as long as they are materials having electrons that function as a charge carrier. The conductive particles may be used singly or in combination of two or more thereof. The particle size is not particularly limited. Among these conductive metal oxide, tin oxide, antimony-doped tin oxide, and anatase type titanium oxide are preferable and tin oxide and antimony-doped tin oxide are more preferable.

Furthermore, a fluorine or silicone based resin is preferably used for the surface layer. In particular, the surface layer is preferably constituted by a fluorine modified acrylate polymer. To the surface layer, particles may be added. Insulating particles, such as alumina or silica, may be added to a surface of the charging member to form a concave portion on the surface of the charging member and thereby to reduce a load at the time of sliding with a photoreceptor, whereby a mutual abrasion resistance of the charging member and the photoreceptor is improved.

The outer diameter of the charging member is preferably from 8 mm to 16 mm. As a method for measuring the outer diameter, the outer diameter may be measured using a commercially-available caliper squares or laser type outer diameter measuring device.

The micro hardness of the charging member is preferably from 45° to 60°. In order to achieve a low hardness, it is possible to use a method of increasing an addition amount of plasticizers or a method of using a low-hardness material such as a silicone rubber.

As a micro hardness of the charging member, a value measured by a Model MD-1 hardness tester manufactured by Kobunshi Keiki Co., Ltd. is used.

With respect to the image forming device according to this exemplary embodiment, process cartridges including a photoreceptor (image holder), a charged device (unit of a charging member and a cleaning member), a developing device, and a cleaning blade (cleaning device) are described above. However, the invention is not limited thereto, and a process cartridge including a charging device (unit of a charging member and a cleaning member) and, in addition thereto if needed, one selected from the group consisting of a photoreceptor (image holder), an exposure device, a transfer device, a developing device, and a cleaning blade (cleaning device) may be acceptable. The devices or members are not always used as a cartridge thereof, but may be directly arranged in the image forming device.

With respect to the image forming device according to this exemplary embodiment, an aspect in which the charging device is constituted by a unit of a charging member and a cleaning member is described above. More specifically, an aspect in which the charging member is employed as a member to be cleaned is described above, but the invention is not limited thereto. Examples of the member to be cleaned include a photoreceptor (image holder), a transfer device (transfer member; transfer roll), and an intermediate transfer body (intermediate transfer belt). A unit of the member to be cleaned and the cleaning member disposed contacting the members to be cleaned may be directly arranged in the image forming device or may be arranged in the image forming device in the form of a cartridge, such as a process cartridge, as described in the above.

The image forming device according to this exemplary embodiment is not limited to the structure described above and known image forming devices, such as an intermediate-transfer system image forming device, may be employed.

Hereinafter, the exemplary embodiments will be described. However, the present invention is not limited thereto.

The invention according to a first aspect is a cleaning member for an image forming device, containing a spindle, a belt-like elastic body spirally wound around an outer circumferential surface of the spindle, and a filling member for filling a portion of a space enclosed by the spindle and the spirally wound belt-like elastic body.

The invention according to a second aspect is the cleaning member for an image forming device according to the first aspect, in which the filling member is provided such that a region in which the filling member and the elastic body contact a member to be cleaned over the axial direction of the spindle is present at a portion of a circumferential direction of the spindle.

The invention according to a third aspect is the cleaning member for an image forming device according to first or second aspect, wherein the belt-like elastic body includes foamed polyurethane.

The invention according to a forth aspect is the cleaning member for an image forming device according to any one of first to third aspects, wherein the belt-like elastic body includes an elastic layer having a helix angle θ of from about 10° to about 65° and a spiral width R1 of from about 3 mm to about 25 mm.

The invention according to a fifth aspect is the cleaning member for an image forming device according to any one of first to forth aspects, wherein the spindle includes a shaft and a length of the filling member along the circumferential direction of the shaft is about ½ or less of a length of the cleaning member along the circumferential direction of the shaft.

The invention according to a sixth aspect is the cleaning member for an image forming device according to any one of first to fifth aspects, wherein the filling members are disposed in a straight line so as to fill spiral spaces along an axial direction of the spindle, or two or more of the filling members are disposed in a lattice configuration so as to fill the spiral spaces at an interval in the spiral direction.

The invention according to a seventh aspect is the cleaning member for an image forming device according to any one of first to sixth aspects, wherein the filling member comprises foamed polyurethane.

The invention according to a eighth aspect is a charging device, containing a charging member for charging a body to be charged, and the cleaning member for an image forming device according to any one of first to seventh aspects which is disposed in contact with the surface of the charging member and which cleans the surface of the charging member.

The invention according to a ninth aspect is the charging device according to the eighth aspect, in which the charging member is a charging member having a charging system in which only a direct current is applied.

The invention according to a tenth aspect is a process cartridge for an image forming device, containing at least the charging device according to the eight or ninth aspect, wherein the process cartridge is detachably placed in the image forming device.

The invention according to an eleventh aspect is an image forming device, containing an image holder, a charging unit which charges a surface of the image holder and includes the charging device according to the eight or ninth aspect, a latent image forming unit for forming a latent image on the surface of the charged image holder, a developing unit for developing the latent image formed on the image holder with a toner as a toner image; and a transfer unit for transferring the toner image to a transfer medium.

According to the invention of the first aspect, the initial charge unevenness to the member to be cleaned is suppressed under environmental conditions of low temperature and low humidity as compared with the case where the filling member is not provided.

According to the invention of the second aspect, the initial charge unevenness to the member to be cleaned is suppressed under environmental conditions of low temperature and low humidity as compared with the case where the filling member is not provided so that a region in which the filling member and the elastic body contact the member to be cleaned over the axial direction of the shaft is present in a portion of the circumferential direction of the spindle.

According to the invention of any one of the third to eight aspects, the initial charge unevenness to the member to be cleaned is suppressed under environmental conditions of low temperature and low humidity as compared with the case where the cleaning member not having the filling member is provided.

According to the invention of the ninth aspect, the initial charge unevenness to the member to be cleaned is suppressed under environmental conditions of low temperature and low humidity even when the charging member having a charging system of applying only a direct current is employed as compared with the case where the cleaning member not having the filling member is provided.

According to the invention according to the tenth or eleventh aspect, the image density unevenness resulting from the initial charge unevenness to the image holder is suppressed under environmental conditions of low temperature and low humidity as compared with the case where the cleaning member not having the filling member is provided.

EXAMPLE

Test Examples

Hereinafter, test examples for confirming the effect of a gear according to the exemplary embodiment above will be described.

In the following description, a cleaning member is referred to as "a cleaning roll", and, in particular, a roll having a spirally disposed elastic layer is referred to as "a spiral cleaning roll", and a roll having a cylindrical elastic layer is referred to as "a cylindrical cleaning roll". In the following test examples, a charging roll which is an example of the charging member is applied.

Reference Example

Figure 10:
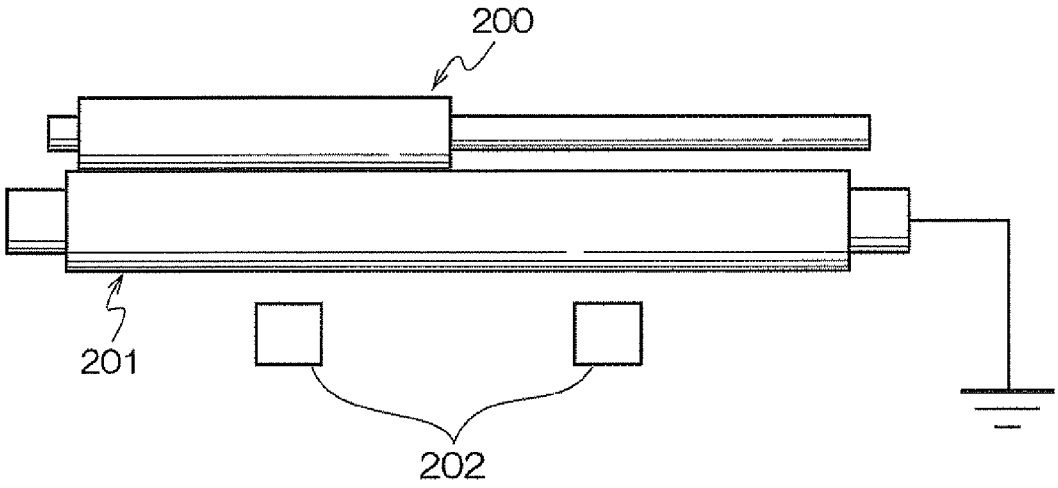
FIG. 10 is a schematic diagram for describing a reference example.

As shown in FIG. 10, a surface potential difference (charge unevenness) of the charging roll caused by the contact/non-contact of the cleaning roll and the charging roll and a charge potential difference on the surface of the photoreceptor due to the surface potential difference are tested. FIG. 10 includes a cylindrical cleaning roll 200, a charging roll 201, and an electrometer 202.

First, the cylindrical cleaning roll (roll having a cylindrical elastic layer) in which only a half of the elastic layer is attached in the axial direction is driven by rotation while contacting the charging roll. Then, a potential of the surface of the charging roll is measured by a surface electrometer. In this case, the shaft of the charging roll is connected to ground. As the charging roll, a ϕ9 charging roll composed of two-layers in which a 1.5 mm thick rubber layer is provided on a ϕ6 shaft, and further the surface of the rubber layer is subjected to iocyanate immersion treatment is used.

As the cleaning roll, a ϕ8 cleaning roll in which a foamed urethane layer having a thickness of 2 mm is provided as an elastic layer on a ϕ4 shaft is used. The test is performed under environment conditions of low temperature and low humidity, specifically temperature of 10° C. and humidity of 15%. The rotation rate of the charging roll is 320 mm/s, and the charging roll is driven for 8 s.

Figure 11:
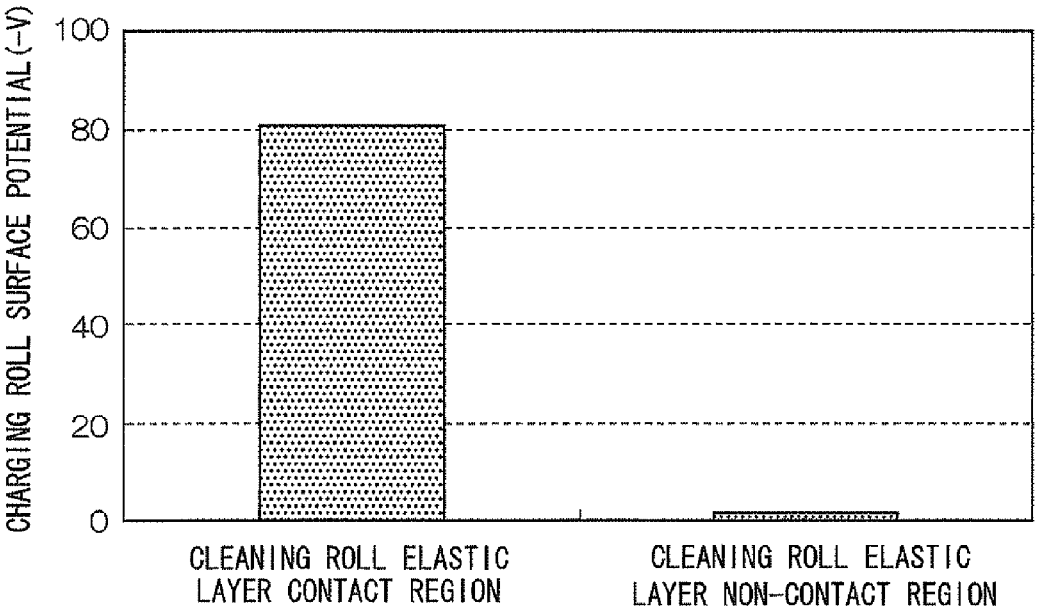
FIG. 11 is a graph showing the relationship between the contact/non-contact of a cleaning roll (an elastic layer thereof) and a charging roll and the surface potential of the charging roll in a reference example.

The results are shown in FIG. 11. On the surface of the charging roll, the potential is 0 V at a portion not contacting the elastic layer of the cleaning roll (cleaning roll elastic layer non-contact region). In contrast, the potential is −80 V at a portion contacting the elastic layer (cleaning roll elastic layer contact region). From these results, it is understood that the surface of the charging roll is charged by the contact friction with the elastic layer of the cleaning roll.

Next, a voltage is applied to the charging roll so that a photoreceptor is charged. Then, the photoreceptor surface potentials corresponding to each of a portion in the charging roll where the elastic layer of the cleaning roll contacts (cleaning roll elastic layer contact region) and another portion in the charging roll where the elastic layer of the cleaning roll does not contact (cleaning roll elastic layer non-contact region) are measured. The environmental conditions are the same as those described above. A process speed at the time of charging is controlled to 165 mm/s. The photoreceptor is a photoreceptor in which a photosensitive layer is coated with a thickness of 34 μm on a ϕ24 Al shaft. A DC voltage of −1360 V is applied.

Figure 12:
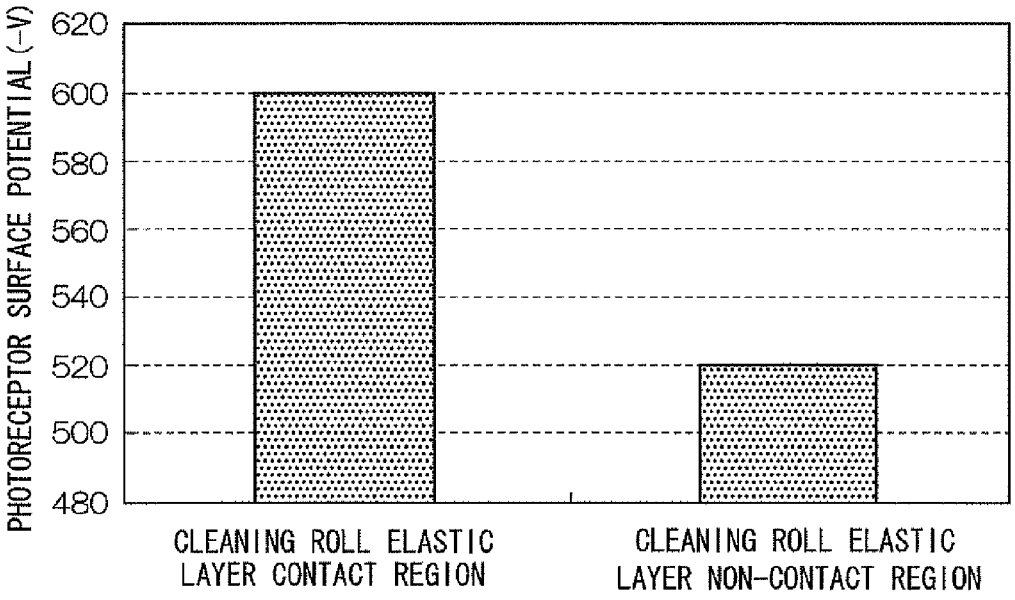
FIG. 12 is a graph showing the relationship between the contact/non-contact of a cleaning roll (an elastic layer thereof) and a charging roll and the surface potential of a photoreceptor in a reference example.

The results are shown in FIG. 12. The photoreceptor surface corresponding to a portion contacting the elastic layer of the cleaning roll in the charging roll is charged to −600 V. In contrast, the photoreceptor surface corresponding to a portion not contacting the elastic layer of the cleaning roll in the charging roll is only charged to a maximum of −520 V. From these results, it is understood that the photoreceptor surface potential corresponding to the portion contacting the elastic layer of the cleaning roll in the charging roll shows a higher value by −80 V that corresponds to the charge (surface potential) of the charging roll (FIG. 12). It is confirmed that when a halftone image (image density of 30%) is formed under the same conditions, the density of an image corresponding to the portion contacting the elastic layer of the cleaning roll in the charging roll is lower than that of an image in a portion corresponding to the non-contact portion, whereby the density level difference appears.

As described above, it is found that the initial charge unevenness to the charging roll (member to be cleaned) arises between the contact region and the non-contact region of the elastic layer of the cleaning roll under environment conditions of low temperature and low humidity, which causes charge unevenness in the photoreceptor (member to be charged) to be charged by the charging roll (member to be cleaned), resulting in image density unevenness.

Test Example 1

On a ϕ4 shaft, a urethane sponge sheet having a thickness of 2.4 mm and a sheet width of 6 mm is spirally wound at a winding angle of 26°, thereby preparing a spiral cleaning roll A having a spiral elastic layer (corresponding to Comparative Example).

Further, a spiral cleaning roll B1 (equivalent to Example: refer to FIGS. 1 and 2) is prepared in which urethane sponge pieces (a filling member) composed of the same material as the urethane of the elastic layer and having a sheet thickness of 2.4 mm, a length in the axial direction of 13 mm, and a length in the circumferential direction of 5 mm are disposed in a straight line on one portion of the circumferential surface of the shaft of the spiral cleaning roll A in such a manner as to fill the spiral spaces with the urethane sponge pieces along the axial direction of the shaft.

Moreover, a spiral cleaning roll B2 (corresponding to Example: refer to FIG. 4) is prepared in which urethane sponge pieces (a filling member) composed of the same material as the urethane of the elastic layer and having a sheet thickness of 2.4 mm, a length in the axial direction of 13 mm, and a length in the circumferential direction of 5 mm are disposed on one portion of the circumferential surface of the shaft of the spiral cleaning roll A in such a manner as to fill the spiral spaces with the urethane sponge pieces in the shape of a lattice.

Then, the spiral cleaning rolls A, B1, and B2 are placed in an image forming device (disposed in such a manner as to contact the charging member thereof). Then, formation of halftone images (image density of 30%) is performed under environmental conditions of low temperature and low humidity.

The conditions of the charging roll and the photoreceptor in this Test Example are the same as those of the Reference Example, and a DC voltage (−1360 V) is applied to the charging roll.

Figure 13:
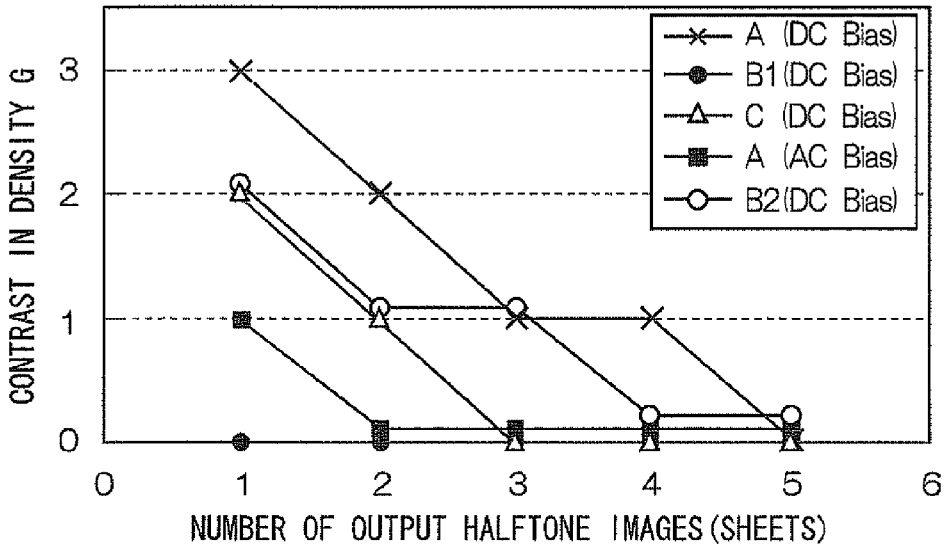
FIG. 13 is a graph showing the results of Test Example 1.

The results are shown in FIG. 13. A contrast in density appears in the shape of a spiral mark in the halftone image output using the spiral cleaning roll A, and then the contrast disappears after five-sheet outputting (refer to FIG. 13). In contrast, with respect to the halftone image output using the spiral cleaning roll B1, uniform images are obtained from the first output sheet (refer to FIG. 13). From these results, the following finding is confirmed. Namely, the sponge pieces that are a filling member of gaps of the spiral roll show an effect on suppression of image density unevenness. Accordingly, it is assumed from the results of the Reference Example that the sponge pieces that are a filling member reduce a potential difference due to a change of the cleaning roll whereby image density unevenness is suppressed.

Moreover, in the halftone image output using the spiral cleaning roll B2, a contrast in density appears in the shape of spiral mark, and then the contrast disappears after four-sheet outputting. From this result, the following finding is confirmed. Namely, even when the spiral cleaning rolls B1 and B2 are provided with the same filling member, the spiral cleaning roll B1 provided with the filling member in a straight line in such a manner as to fill the spiral spaces with the filling member along the axial direction of the shaft is confirmed to be more effective for suppressing the image density unevenness due to the sponge pieces that are a filling member of gaps of the spiral roll.

In contrast, even in the case of using the spiral cleaning roll A, when a halftone image is output by applying a voltage (DC+AC=−600 V dc+2.0 kV pp) in which an alternating current (AC) is superimposed on a direct-current voltage (DC) is applied to the charging roll, a contrast in density appears in the shape of spiral mark in the first output halftone image, and then the contrast disappears after two-sheet outputting (refer to FIG. 13). From this result, it is understood that a tendency, in which an initial charge unevenness with respective to a charging roll (a member to be cleaned) is easy to occur between a contact region and a non-contact region of an elastic layer of the cleaning roll, is conspicuous especially when a DC charging system is employed, and the charge unevenness is suppressed using the spiral cleaning roll B1 (corresponding to Example).

Next, a spiral cleaning roll C is prepared in the same manner as in the spiral cleaning roll B1, except that the polyurethane sponge pieces as a filling member is substituted by urethane sponge pieces containing carbon.

The spiral cleaning roll C is placed in an image forming device (disposed in such a manner as to contact the charging member thereof), and formation of halftone images (image density of 30%) is performed under environmental conditions of low temperature and low humidity. The conditions of the charging roll and the photoreceptor in this Test Example are the same as those of the Reference Example, and a DC voltage (−1360 V) is applied to the charging roll.

The results are shown in FIG. 13. Although the spiral cleaning roll C is inferior to the spiral cleaning roll B1, a contrast in density appears in the shape of a spiral mark in the first output halftone image, and then the contrast disappears in the third sheet (refer to FIG. 13). From these results, it is understood that when a material of the elastic layer and a material of the filling member are different from each other in the spiral cleaning roll, a charge level of a contact region of an elastic layer and a surface to be cleaned varies from a charge level of a contact region of the filling member and a surface to be cleaned, which results in reduction in an effect on inhibition of charge unevenness (inhibitory effect of image density unevenness), and accordingly the material of the elastic layer and the material of the filling member are preferably the same.

In FIG. 13, the contrast in density G refers to a grade showing a degree of a difference in density which results in image density unevenness. Herein, "1" indicates that the image density unevenness very slightly arises (level in which the image density unevenness is not recognized unless pointed out), "2" indicates that the image density unevenness slightly arises, and "3" indicates that the image density unevenness conspicuously arises.

Test Example 2

A cylindrical cleaning roll D (corresponding to Comparative Example) in which a 2 mm-thick urethane sponge layer (elastic layer) is formed on a ϕ4 shaft is prepared.

Further, a spiral cleaning roll E (corresponding to Example: refer to FIGS. 1 and 2) is prepared in which urethane sponge pieces (a filling member) composed of the same material as the urethane of the elastic layer and having a sheet thickness of 2.4 mm, a length in the axial direction of 13 mm, and a length in the circumferential direction of 15 mm are disposed in a straight line on one portion of the circumferential surface of the shaft of the spiral cleaning roll A in such a manner as to fill the spiral spaces with the urethane sponge pieces along the axial direction of the shaft.

Moreover, a spiral cleaning roll F (corresponding to Example: refer to FIGS. 1 and 2) is prepared in which urethane sponge pieces (a filling member) composed of the same material as the urethane of the elastic layer and having a sheet thickness of 2.4 mm, a length in the axial direction of 13 mm, and a length in the circumferential direction of 15 mm are disposed in a straight line on one portion of the circumferential surface of the shaft of the spiral cleaning roll A in such a manner as to fill the spiral spaces with the urethane sponge pieces in the shape of a lattice.

Then, the cleaning rolls A to B and D to F are placed in an image forming device (disposed in such a manner as to contact the charging member thereof), and a running test is carried out using an actual machine. Then, the relationship between the number of cycles of the photoreceptor (number of rotations) and stain streaks of images resulting from a stain of a charging roll is evaluated.

The conditions of the charging roll and the photoreceptor in this Test Example are the same as those of the Reference Example, and a DC voltage (−1360 V) is applied to the charging roll.

Figure 14:
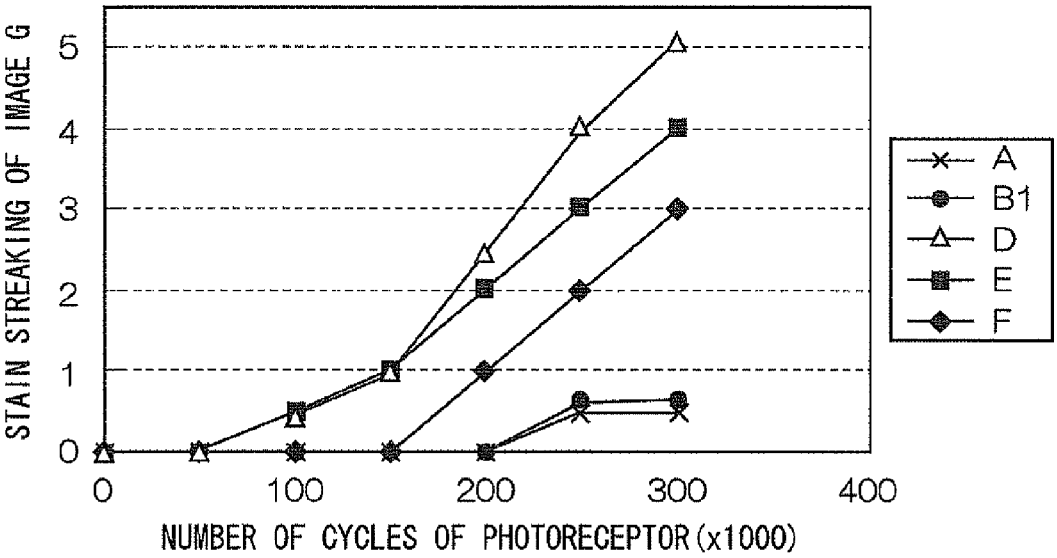
FIG. 14 is a graph showing the results of Test Example 2.

The results are shown in FIG. 14. In the spiral cleaning rolls A and B1, stain streaks do not occur in 300,000 cycles (300,000 rotations) of the photoreceptor. From this result, it is understood that the cleanability is excellent.

In contrast, the spiral cleaning roll F is better than the cylindrical cleaning roll D, but is inferior to the spiral cleaning rolls A and B1. The spiral cleaning roll E is better than the cylindrical cleaning roll D, but is inferior to the spiral cleaning roll F. These results show that, in order to suppress a reduction in cleanability, it is preferable that the length in the circumferential direction of the filling member of the spiral cleaning roll (the length at the circumferential direction of the filling member disposed in a straight line so as to fill the spiral spaces with the urethane sponge pieces along the axial direction of the shaft) is not excessively large (e.g., ½ or lower of an length of the cleaning roll in the circumferential direction).

In FIG. 14, the "Stain streaking of image G" refers to a grade showing a degree of stain streaking of image, in which "1" indicates that one very slight streaking occurs in the image (level in which the stain streaking of image is not recognized unless pointed out), "2" indicates that some very slight streaking (within 5 lines) occurs in the image, and "3" indicates that some slight streaking (within 5 lines) occurs in the image, "4" indicates that some streaking having a strong contrast occurs in the image, or slight streaking occurs in all over the image and "5" indicates that streaking having a strong contrast occurs in all over the image.

What is claimed is:

1. A cleaning member for an image forming device, comprising:

a spindle;

a belt-like elastic body spirally wound around an outer circumferential surface of the spindle; and one or more filling members, each filling member of the one or more filling members is disposed such that a portion of a space enclosed by the spindle and the spirally wound belt-like elastic body is not filled with the one or more filling members, wherein ½ or less of the space enclosed by the spindle and the spirally wound belt-like elastic body is filled with the one or more filling members.

2. The cleaning member for an image forming device according to claim 1, wherein each filling member of the one or more filling members is disposed such that a region in which the filling member and the elastic body contact a member to be cleaned along an axial direction of the spindle is present at a portion of a circumferential direction of the spindle.

3. The cleaning member for an image forming device according to claim 1, wherein the belt-like elastic body comprises foamed polyurethane.

4. The cleaning member for an image forming device according to claim 1, wherein the belt-like elastic body comprises an elastic layer having a helix angle θ of from about 10° to about 65° and a spiral width R1 of from about 3 mm to about 25 mm.

5. The cleaning member for an image forming device according to claim 1, wherein the one or more filling members are disposed in a straight line so as to not fill spiral spaces along an axial direction of the spindle, or if the one or more filling members includes two or more filling members, the two or more filling members are disposed in a lattice configuration so as to not fill the spiral spaces at an interval in the spiral direction.

6. The cleaning member for an image forming device according to claim 1, wherein each filling member of the one or more filling members comprises foamed polyurethane.

7. A charging device, comprising:

a charging member that charges a member to be charged; and the cleaning member for an image forming device according to claim 1, which is disposed in contact with the surface of the charging member and cleans the surface of the charging member.

8. The charging device according to claim 7, wherein the charging member is a charging member having a charging system in which only a direct current is applied.

9. A process cartridge for an image forming device, comprising the charging device according to claim 7, wherein the process cartridge is detachably placed in the image forming device.

10. An image forming device, comprising:

an image holder;

a charging unit that charges the surface of the image holder and comprises the charging device according to claim 7;

a latent image forming unit that forms a latent image on the surface of the charged image holder;

a developing unit that develops the latent image formed on the image holder with a toner as a toner image; and a transfer unit that transfers the toner image to a transfer medium.

11. A cleaning member for an image forming device, comprising:

a spindle;

a belt-like elastic body spirally wound around an outer circumferential surface of the spindle; and one or more filling members, each filling member of the one or more filling members is disposed such that a portion of a space enclosed by the spindle and the spirally wound belt-like elastic body is not filled with the one or more filling members, wherein the spindle comprises a shaft and a length of the one or more filling members along a circumferential direction of the shaft is about ½ or less of a length of the cleaning member along the circumferential direction of the shaft.

* * * * *